US007227517B2

(12) United States Patent
Imamura

(10) Patent No.: US 7,227,517 B2
(45) Date of Patent: Jun. 5, 2007

(54) ELECTRONIC DEVICE DRIVING METHOD, ELECTRONIC DEVICE, SEMICONDUCTOR INTEGRATED CIRCUIT, AND ELECTRONIC APPARATUS

(75) Inventor: Yoichi Imamura, Chino (JP)

(73) Assignee: Seiko Epson Corporation, Tokyo (JP)

( * ) Notice: Subject to any disclaimer, the term of this patent is extended or adjusted under 35 U.S.C. 154(b) by 565 days.

(21) Appl. No.: 10/224,382

(22) Filed: Aug. 21, 2002

(65) Prior Publication Data

US 2003/0133243 A1 Jul. 17, 2003

(30) Foreign Application Priority Data

Aug. 23, 2001 (JP) ..... 2001-253473

(51) Int. Cl.
*G09G 3/30* (2006.01)

(52) U.S. Cl. ..... 345/76; 345/77

(58) Field of Classification Search ..... 346/76–83, 346/36, 44–46, 204; 315/169.1, 169.3
See application file for complete search history.

(56) References Cited

U.S. PATENT DOCUMENTS

| | | | | |
|---|---|---|---|---|
| 3,629,653 | A * | 12/1971 | Munt | 315/169.3 |
| 4,775,891 | A * | 10/1988 | Aoki et al. | 348/572 |
| 5,644,327 | A * | 7/1997 | Onyskevych et al. | 345/80 |
| 5,990,629 | A | 11/1999 | Yamada et al. | |
| 6,091,515 | A * | 7/2000 | Kimura | 358/434 |
| 6,222,515 | B1 * | 4/2001 | Yamaguchi et al. | 345/89 |
| 6,583,775 | B1 * | 6/2003 | Sekiya et al. | 345/76 |
| 6,731,276 | B1 | 5/2004 | Ishizuka | |
| 6,803,890 | B1 * | 10/2004 | Velayudhan et al. | 345/76 |
| 6,828,950 | B2 * | 12/2004 | Koyama | 345/76 |
| 2001/0019319 | A1 * | 9/2001 | Kim | 345/77 |
| 2002/0140659 | A1 * | 10/2002 | Mikami et al. | 345/90 |
| 2004/0207615 | A1 * | 10/2004 | Yumoto | 345/211 |
| 2005/0012696 | A1 * | 1/2005 | Kimura | 345/76 |

FOREIGN PATENT DOCUMENTS

| | | |
|---|---|---|
| JP | A-2001-42822 | 2/2001 |
| JP | 2001-142413 | 5/2001 |
| JP | A-2001-142427 | 5/2001 |
| KR | 2000-005040 | 8/2000 |

OTHER PUBLICATIONS

Matsumoto, Shoichi, *Electronic Display*, Ohmsha, Ltd., Jun. 20, 1996, p. 137 (English-language translation).

* cited by examiner

*Primary Examiner*—Regina Liang
(74) *Attorney, Agent, or Firm*—Oliff & Berridge, PLC

(57) ABSTRACT

A display device includes a plurality of scanning lines, a plurality of signal lines, and current-driven elements provided corresponding to portions where the scanning lines and the signal lines cross one another. The display device performs a display operating in response to the amount of a driving current supplied to the current-driven elements. The amount of the driving current is defined by the value of the driving current and the length of a period in which the driving current, which is periodically repeated, is supplied to the current-driven elements. This definition of the amount of the driving current can realize accurate gray scale control in a minute current region and a reduction in power consumption of the display device.

20 Claims, 13 Drawing Sheets

GRADATION CONVERSION TABLE

ELECTRONIC DEVICE DRIVING METHOD, ELECTRONIC DEVICE, SEMICONDUCTOR INTEGRATED CIRCUIT, AND ELECTRONIC APPARATUS

BACKGROUND OF THE INVENTION

1. Field of Invention

The present invention relates to an electronic device driving method, an electronic device, a semiconductor integrated circuit, and an electronic apparatus.

2. Description of Related Art

The related art includes active-matrix picture display apparatuses which, by using low-temperature polysilicon thin-film transistors (hereinafter "LT-TFTs"), a silicon integrated circuit, or organic transistors, drives electroluminescence elements (hereinafter "organic EL elements" and are irrespective of difference between emission material types) in which light is emitted by the flow of a driving current in an emission thin film, such as an organic semiconductor, vacuum fluorescent display devices (hereinafter "VFDs"), inorganic electroluminescence elements, laser devices, such as light-emitting-diodes (LED-device) surface-emitting lasers (VCSELs), or current-controlled thin-film emitting devices, such as field emission devices (FEDs). Driving control by TFT is suitable for a case in which a current of several μA (microamperes) or less causes thin-film light-emitting devices to emit light.

With noticeable progress in technological development, the emission efficiency of an organic EL element increases, and in accordance therewith, a small driving current enables light emission, so that each of the organic EL elements using LT-TFTs to form pixels becomes able to be driven by each LT-TFT.

However, with a rapid increase in the emission efficiency of the organic EL element, when a screen having uniform brightness is formed, accurate control becomes difficult because a driving current in a low gray scale region is too minute, even though no problem occurs based on a relatively large driving current in high and intermediate gray scale regions. The minute current in the region is 10 nA (nanoamperes), and is not so different from a leak current in the off mode of a driving transistor.

Accordingly, when a TFT to drive a light-emitting pixel is turned off, a leak current from an adjacent wire flows into a light-emitting pixel in a non-light-emitting state, so that a non-light-emitting device that cannot emit light emits weak light, thus causing contrast decreases and contour blurring. Under such circumstances, displaying must be performed in high and intermediate current ranges because accurate gray scale displaying cannot be performed in a minute current range, even if the emission efficiency of the organic EL element increases. This is a problem in reducing power consumption of an organic EL display in which power to cause organic EL elements to emit light is dominant.

To perform low-brightness displaying or displaying in the low gray scale region, LT-TFT circuits to drive pixels must accurately operate corresponding to gray scale currents. However, in accordance therewith, even if minute currents are written from a driver to LT-TFT circuits including analog memories of pixels, slow response in time of the LT-TFTs and leak current cause cases in which the writing does not end within the predetermined writing time required for a periodic display-refresh operation and in which it is difficult to accurately maintain the written values.

SUMMARY OF THE INVENTION

The present invention provides a technology to realize accurate gray scale control in a minute current region and a reduction in the current consumption of a display.

A electronic device driving method according to the present invention drives an electronic device, which includes a plurality of scanning lines, a plurality of signal lines, and current-driven elements provided corresponding to portions where the scanning lines and the signal lines cross one another, and which operates in response to the amount of a driving current supplied to the current-driven elements. The amount of the driving current, which is periodically repeated, is defined by the value of the driving current and the length of a period in which the driving current is supplied to the current-driven elements.

In the electronic device driving method, the value of the driving current may be arbitrarily changed.

In the electronic device driving method, the current-driven elements may be current-driven optical elements having current-controlled optical characteristics.

In the electronic device driving method, the length of the period in which the driving current is supplied may be arbitrarily changed.

In the electronic device driving method, off-control transistors may be connected in series to the current-driven elements, and by controlling timing to turn on and off the off-control transistors, the period in which the driving current is supplied may be arbitrarily changed.

In the electronic device driving method, the length of the period in which the driving current may be supplied is arbitrarily changed by the off-control transistors, and the off-control transistors may share portions of a circuit to set the value of the driving-current.

In the electronic device driving method, organic electroluminescence elements can be employed as the current-driven optical elements, and in this case, the gray scale level of the organic electroluminescence elements can be set as the amount of the driving current.

In the electronic device driving method, it is preferable that the period in which the driving current is supplied to the current-driven elements include at least two sub-periods.

In the electronic device driving method, it is preferable that, when displaying with a low gray scale level or light emission with a low brightness is performed, the driving current be supplied to the current-driven elements in either of the sub-periods.

In the electronic device driving method, it is preferable that, when at least the lowest gray scale level is represented among a plurality of gray scale levels represented by supplying the driving current to the current-driven elements, the sub-period is provided in which the driving current is not supplied to the current-driven elements.

In the electronic device driving method, the sub-period in which the driving current is supplied to the current-driven elements may be identical or longer in length than the sub-period in which the driving current is not supplied.

In the electronic device driving method, it is preferable that, when the driving current, which is periodically repeated, is supplied to the current-driven elements, the frequency thereof be set to 50 Hz or greater.

In the electronic device driving method, in performing scanning using the scanning lines, leaped scanning may be performed. For example, a type of leaped scanning, or the like, is enumerated as the interlaced scanning.

A first exemplary electronic device of the present invention is an electronic device which includes a plurality of scanning lines, a plurality of signal lines, and current-driven elements provided corresponding to portions where the scanning lines and the signal lines cross one another, and which operates in response to the amount of a driving current supplied to the current-driven elements. The amount of the driving current, which is periodically repeated, is defined by the value of the driving current and the length of a period in which the driving current is supplied to the current-driven elements.

In the above electronic device, the value of the driving current may be arbitrarily changed.

In the above electronic device, the current-driven elements may be current-driven optical elements having current-controlled optical characteristics.

In the above electronic device, the length of the period in which the driving current is supplied may be arbitrarily changed.

In the above electronic device, off-control transistors may be connected in series to the current-driven elements, and by controlling timing to turn on and off the off-control transistors, the period in which the driving current is supplied may be arbitrarily changed.

In the above electronic device, the length of the period in which the driving current is supplied may be arbitrarily changed by the off-control transistors, and the off-control transistors may share portions of a circuit to set the value of the driving current.

In the above electronic device, it is preferable that a plurality of display-off control scanning lines be provided corresponding to the plurality of scanning lines, the off-control transistors be connected to the display-off control scanning lines, and a display-off scanning-line driving circuit be provided which outputs a display-off scanning signal to the off-control transistors through one display-off scanning line corresponding to a selected scanning line while synchronizing with the operation for the selection of the scanning line.

In the above electronic device, the display-off scanning-line driving circuit may be controlled by a control circuit which controls a scanning-line driving circuit to selectively control the plurality of scanning lines and a data-line driving circuit to supply data signals to the plurality of signal lines.

In the above electronic device, organic electroluminescence elements can be employed as the current-driven optical elements, and in this case, the gray scale level of the organic electroluminescence elements can be set as the amount of the driving current.

In the above electronic device, it is preferable that the period in which the driving current is supplied to the current-driven elements includes at least two sub-periods.

In the above electronic device, it is preferable that, when displaying with a low gray scale level or light emission with a low brightness is performed, the driving current be supplied to the current-driven elements in either of the sub-periods.

In the above electronic device, it is preferable that, when at least the lowest gray scale level be represented among a plurality of gray scale levels represented by supplying the driving current to the current-driven elements, the sub-period in which the driving current is not supplied to the current-driven elements is provided.

In the above electronic device, it is preferable that the sub-period in which the driving current is supplied to the current-driven elements be identical or longer in length than the sub-period in which the driving current is not supplied.

In the above electronic device, it is preferable that, when the driving current, which is periodically repeated, is supplied to the current-driven elements, the frequency thereof be set to 50 Hz or greater.

In the electronic device driving method, in performing scanning using the scanning lines, leaped scanning may be performed. For example, a type of leaped scanning, or the like, is enumerated as the interlaced scanning.

A second electronic device of the present invention is an electronic device which includes a plurality of first signal lines, a plurality of second signal lines, and driven elements provided corresponding to portions where the plurality of signal lines and the plurality of second signal lines cross one another, which operates in response to the amount of a driving current supplied to the driven elements. The amount of the driving current is set by the value of the driving current and the length of a sub-period which is provided in a predetermined periodically-repeated period and in which the driving current is supplied to the driven elements. Various electronic elements, such as, for example, electro-optical elements and current-driven elements, are enumerated as the driven elements.

In a second exemplary electronic device of the present invention, it is preferable that the length of the sub-period differs depending on the amount of the driving current or the type of the driven elements. For example, when the amount of the driving current is small, the sub-period may be shortened. Alternatively, when the type or electric characteristics of the driven elements differs, the length of the sub-period may be set in accordance with them. More specifically, when the electric characteristics of R (red), G (green), and B (blue) as in organic EL elements, which are described later are different, by setting the length of the sub-period, as required, the brightnesses of R (red), G (green), and B (blue) may be balanced.

The detailed mode of the second exemplary electronic device of the present invention is similar to that of the above first exemplary electronic device of the present invention.

A semiconductor integrated circuit of the present invention is a semiconductor integrated circuit to supply a driving current to driven elements. The amount of the driving current supplied can be set by the value of the driving current and the length of a sub-period which is provided in a predetermined periodically-repeated period and in which the driving current is supplied to the driven elements.

BRIEF DESCRIPTION OF THE DRAWINGS

Other features of the present invention will become apparent from the attached drawings the following description.

DETAILED DESCRIPTION OF PREFERRED EMBODIMENTS

Regarding the electronic device and its driving method according to the present invention, the following exemplary embodiments can be selectively employed, as required.

The driving current value is set to a plurality of arbitrary values according to an amount of operation. These values are at least three values.

Current-driven elements may be current-driven optical elements whose optical characteristics are controlled by a current.

The current-driven elements are organic electroluminescence elements (organic EL elements), and the amount of driving current may correspond to a gray scale level.

The period in which the driving current is supplied to the current-driven elements may include a driving period having at least two sub-periods which is repeated periodically.

When low-gray scale displaying is performed, only in the first sub-period of the sub-periods, the driving current may be supplied to the current-driven elements.

Among a number of gray scale levels expressed by supplying the driving current to the current-driven elements, when gray scale level 1 is expressed, the sub-period, in which the driving current is not supplied to the current-driven element, may be provided.

The sub-period in which the driving current is supplied to the current-driven elements may be identical in length to or longer in length than the sub-period in which the driving current is not supplied.

When the driving current is periodically supplied to the current-driven elements, its frequency may be 50 Hz or greater in order to reduce or prevent flickering, etc., from occurring.

Similarly, to reduce or prevent flickering, etc., from occurring, when performing scanning using the scanning lines, scanning of an leaped type or the like may be performed.

First Exemplary Embodiment

A first exemplary embodiment of the present invention is described. In this exemplary embodiment, for an electronic device and its driving method according to the present invention, an organic EL display device and a gray scale-display control method are described as examples.

Figure 1:
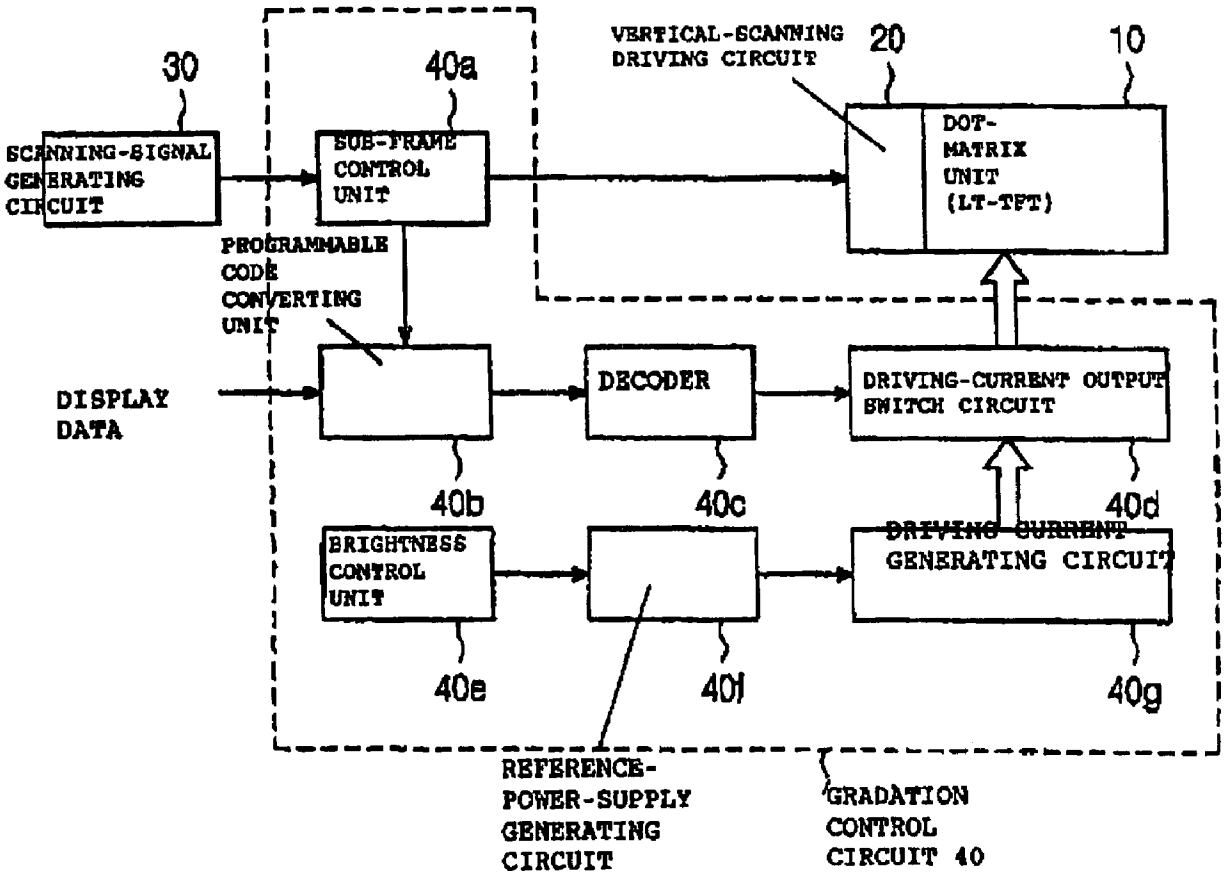
FIG. 1 is a schematic of a circuit of an organic EL display device according to a first exemplary embodiment of the present invention.

As the circuit block diagram of the organic EL display device in FIG. 1 shows, the apparatus includes a display dot matrix unit 10, a vertical scanning driving circuit 20 incidental thereto, a scanning signal generating circuit 30, and a driving (gray scale control) circuit 40 to supply a display data signal and power (driving current) to the display dot matrix unit 10.

The display dot matrix unit 10, in which organic EL elements are used as light-emitting devices, is formed by arranging unit pixels including organic EL elements in the form of a matrix, as is well known. This structure can also be provided via later developed technology. Regarding a circuit configuration and operation of the unit pixel, as is described (particularly at page 137) in, for example, the book name "Electronic Display" (written by MATSUMOTO Shoichi, published by Ohmsha, Ltd., issued on Jun. 20, 1996), by supplying a driving current to each unit pixel, and performing writing at a predetermined voltage to an analog memory composed of two transistors and a capacitor, light emission of organic EL elements is controlled. In the present invention, LT-TFTs are suitable as these active elements, and thin-film diode devices, etc., such as high-temperature polysilicon TFTs, amorphous TFTs, monocrystal TFTs, silicon-base MOS transistors, and MIM (Metal Insulator Metal) devices, can be used.

The driving circuit 40, or the scanning signal generating circuit 30, is realized by driver ICs, and includes, as functional blocks, a sub-frame (sub-period) control unit 40*a*, a programmable code converting unit 40*b*, a decoder 40*c*, a current output switch circuit 40*d*, a brightness control unit 40*e*, a reference-current-supply generating circuit 40*f*, and a driving current generating circuit 40*g*. The sub-frame control unit 40*a* generates, based on an output signal from the scanning signal generating circuit 30, scanning clocks for scanning by dividing each frame time into a plurality of sub-frame times (sub-periods), and outputs the clocks to the vertical scanning circuit 20. It also outputs a sub-frame (sub-period) separating signal to the programmable code converting unit 40*b*. The programmable code converting unit 40*b*, to which the sub-frame separating signal is input, performs conversion in accordance with a prestored gray scale conversion table (described later) on a display decoder from a control side which is not shown, and outputs a digital signal to the decoder unit 40C. The decoder unit 40*c*, to which this digital signal is input, outputs, to the driving current output switch circuit 40*d*, a combination to output predetermined driving currents.

On the other hand, after receiving a contrast control signal from a manual input or an external light sensor which is not shown, the brightness control unit 40*e* outputs, based thereon, a predetermined brightness control signal to the reference-current-supply generating circuit 40*f*. The reference-current-supply generating circuit 40*f*, to which this brightness control signal is input, generates and outputs a predetermined reference current based thereon to the driving current generating circuit 40*g*. The driving current generating circuit 40*g* is constituted by a plurality of current supplies which are differently weighted beforehand so that the driving current increases or decrease in a form which is logarithmically close to a straight line. The current output switch circuit 40*d* selects, based on an output of the decoder 40*c*, a combination of current supplies, and converts digital display data into an analog current value. A plurality of current outputs of the current output switch circuit 40*d* are simultaneously supplied to data lines of the dot matrix unit 10 in synchronization with an output of the vertical scanning driving circuit 20. For example, a current-mirror circuit is used as the reference-current-supply generating circuit 40*f*, and it compares and changes all current values of the current supplies in the driving current generating circuit 40*g*, and outputs the values. This increases or reduces the brightness range, so that the brightness of screen (the entirety of the dot matrix) is adjusted. The programmable code converting unit 40*b*, the decoder 40*c*, the driving current generating circuit 40*g*, and the current output switch circuit 40*d* constitute a D/A converting circuit for outputting gray scale driving currents to the display dot matrix unit 10.

As is well known, in the display dot matrix unit 10, an organic EL element corresponding to each pixel emits light in accordance with an input scanning-line selecting signal and logarithm driving current, whereby a predetermined image is controlled and displayed. This operation can also be provided via later developed techniques.

In the organic EL elements having the structure and functions, a gray scale-display control method according to this exemplary embodiment is described. As the gray scale conversion table for display data codes in FIG. 2 shows, when display data codes are input to the programmable code converting unit 40*b*, the codes are converted and output to the decoder 40*c*, with them time-divided into a first sub-frame (first sub-period) and a second sub-frame (second sub-period).

In this exemplary embodiment, it is preferable that, in the time ratio between the first sub-frame and the second sub-frame, the first sub-frame be 0.7 to 0.3 and the second sub-frame be accordingly 0.3 to 0.7.

Figure 2:
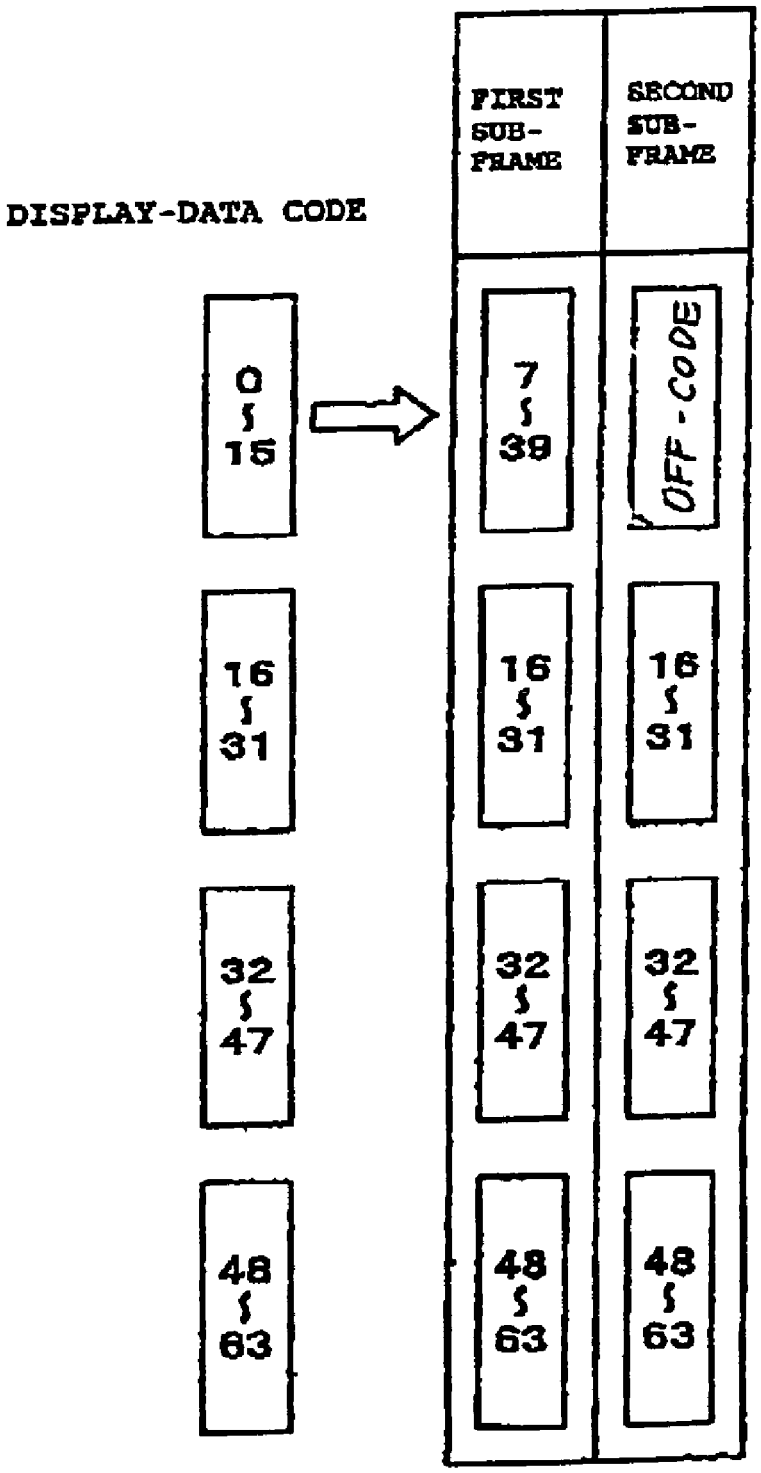
FIG. 2 is a chart showing a display-data-code gray scale conversion table in a gray scale control method for the organic EL display device according to the first exemplary embodiment of the present invention.

The display data codes are separated by gray scale region into four blocks from a low gray scale region ("0 to 15" in FIG. 2) to a high gray scale region ("48 to 63" in FIG. 2). The display data codes in the blocks ("16 to 31", "32 to 47", and "48 to 63") other than the low gray scale region are output as identical codes to the decoder 40*c* from both the first sub-frame and the second sub-frame without being converted. In this case, since the two sub-frames have identical codes, there is almost no time of writing in the second sub-frame to the analog memory of each pixel.

Also, in accordance with a feature of the present invention, regarding conversion of display data codes in each block, the display data codes ("0 to 15") of the low gray scale region in the first sub-frame are set to "16 to 39" in which the gray scale level is higher (writing current is larger) and the writing current value interval is wider. In addition, in the second sub-frame, display-off codes are automatically assigned, and in this period, the organic EL elements are prevented from emitting light.

As a result, human eyes recognize the brightness averaged by integration. This is shown by β in a gray scale characteristic graph of FIG. 3 which shows pixel brightness with respect to the driving current supplied from the driving current output switch circuit 40*d*. At first, in relatively higher brightness (the range from point A to point B in the vertical axis in FIG. 3) other than the low gray scale region, both the first sub-frame and the second sub-frame are regions (corresponding to the blocks "16 to 31", "32 to 47", and "48 to 63" in the first and second sub-frames in FIG. 2) in which display-data-code conversion is not performed. Thus, both have gray scale characteristics substantially similar to related art ones which are indicated by a curve (solid line portion) of α in the graph. On the curve of α in the graph, a point corresponding to A on the vertical axis corresponds to the value "63" in the display data code in FIG. 2, and a point corresponding to B on the same axis corresponds to the value "16" in the display data code in FIG. 2. In this range, the value of the driving current on the horizontal axis is never small, and this range is not affected by the leak current from the driving transistor, which is pointed out in the above Description of Related Art.

Figure 3:
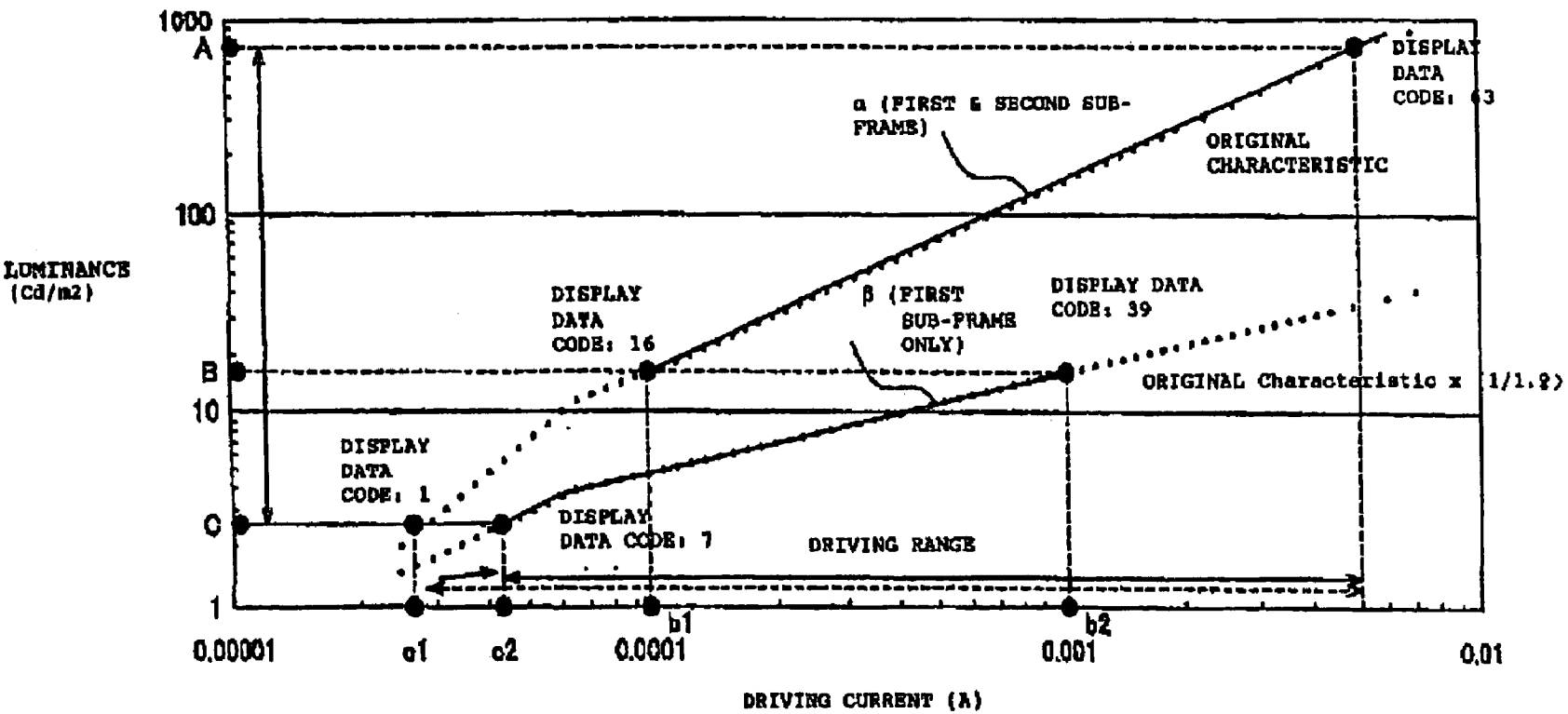
FIG. 3 is a gray scale characteristics graph showing pixel brightness (gray scale-reproduction range) to a driving current in the gray scale control method for the organic EL display device according to the first exemplary embodiment of the present invention.

Also, in relatively lower brightness in the low gray scale region shown in the range of point B to point C on the vertical axis shown in FIG. 3, α in the graph is also controlled as to gray scale on the curve. Thus, as shown in the range of point c1 to point b1 on the horizontal axis in the figure, the driving current is extremely minute and the range is narrow. Accordingly, due to the influence of the leak current from the driving transistor and insufficient writing, a decrease in contrast and contour blurring occur.

Conversely, in the present invention, to realize the relatively lower brightness in the same low range gray scale region shown in FIG. 3, by way of an example, gray scale control is performed on the curve of graph β in which the ratio between the first sub-frame period and the second sub-frame period is set to 0.64:0.36, thus enabling by-current driving in a large and broad range of point c2 to point b2 on the horizontal axis in the same figure. In other words, as described above, this low gray scale region corresponds to the range of the display data codes "16 to 39" ("0 to 15" before conversion) in the first sub-frame in the gray scale-conversion table in FIG. 2. Specifically, the period of the second sub-frame is not displayed after the code conversion. Thus, this causes the curve (solid line) of graph β in FIG. 3 for human eyes to observe as if, for the same driving current, it was lower in brightness on the whole than that on graph α, and characteristics in which the curve is relatively flat are obtained. As a result, for a range having the same brightness, the driving current is generated so as to be large and broad (point c2 to point b2 on the horizontal axis in the same figure). A point on the curve of graph β which is closest to B on the vertical axis corresponds to the value "39" of the display data code in the first sub-frame in FIG. 2, and a point corresponding to C on the same axis corresponds to the value "7" of the display data code in FIG. 2.

Figure 4:
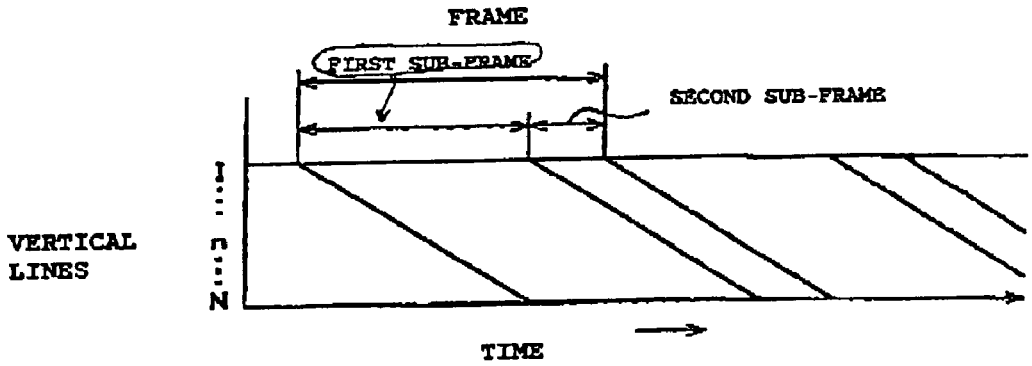
FIGS. 4(*a*) and 4(*b*) are schematics that show a scanning method for selecting a scanning line (vertical line) in the gray scale control method for the organic EL display device according to the first exemplary embodiment of the present invention, where FIG. 4(*a*) is a graph that shows the case of line-sequential scanning, and FIG. 4(*b*) is a graph that shows the case of first performing odd-vertical-line scanning.
Figure 4:
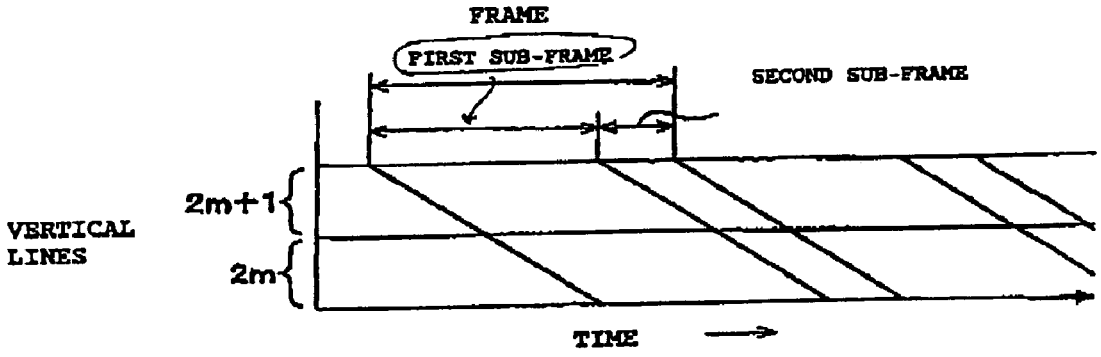

In scanning by the scanning lines (vertical lines), scanning is performed with respect to the time domain, as shown in FIG. 4(*a*), and the frame frequency is set to 50 Hz or greater in this time. This can reduce or prevent flickers (so-called flickering) caused by driving using division into sub-frames.

Also, another scanning method may be employed. In other words, in scanning by scanning lines (vertical lines), as shown in FIG. 4(*b*), scanning by odd-numbered scanning lines (in the figure, 2 m+1: m is a natural number) is performed in advance with respect to the time domain, in other words, so-called interlaced scanning over only even-numbered scanning lines is performed, and after that, scanning by only the even-numbered scanning lines is performed. This can reduce or prevent flickers from occurring, even if the frame frequency is low (e.g., 50 Hz or less), can reduce appearance of a pseudo-contour, and can reduce power consumption or achieve low power consumption. In addition, the writing time can be set to be relatively long, thus enabling sufficient writing.

Although, in this exemplary embodiment, the number of sub-frames (sub-periods) is two, it is not limited thereto, but a plurality of sub-frames can constitute one frame. In the description an organic EL element is used as the light-emitting device. However, a current-driven element that is driven by a flow of a current may be used.

Figure 5:
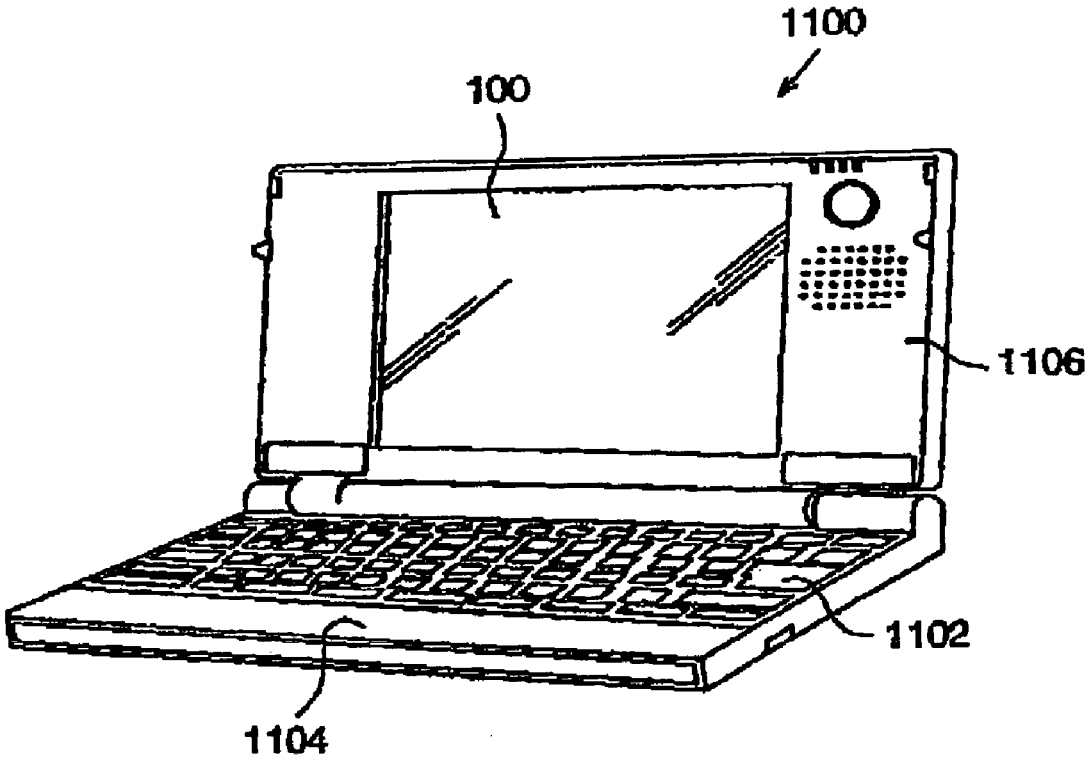
FIG. 5 is a schematic perspective view of an example in which the electronic device according to the first exemplary embodiment of the present invention is applied to a mobile personal computer.

Next, some of examples in which organic EL elements are used in specific electronic apparatuses are described as exemplary embodiments of the above electronic device. At first, an example in which an organic EL display unit according to this exemplary embodiment is applied to a mobile personal computer. FIG. 5 is a perspective view of the structure of this mobile personal computer. In FIG. 5, a personal computer 1100 includes a main unit 1104 including a keyboard 1102, and a display unit 1106, and the display unit 1106 includes the above-described organic EL display device.

Figure 6:
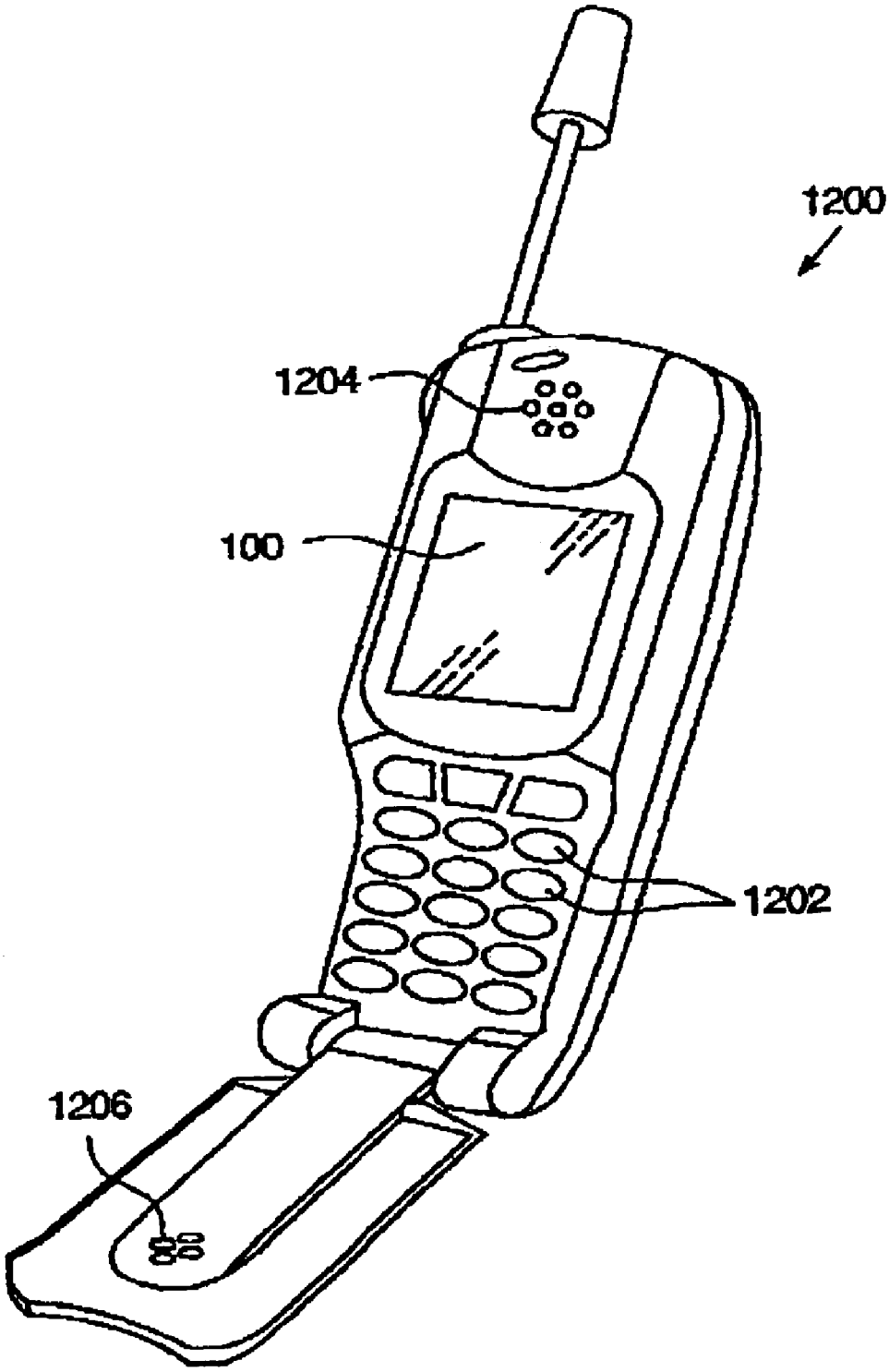
FIG. 6 is a schematic perspective view of an example in which the electronic device according to the first exemplary embodiment of the present invention is applied to the display unit of a cellular telephone.

In addition, FIG. 6 is a perspective view of the structure of a cellular phone in which the above-described organic EL display device is applied to its display unit. In FIG. 6, a cellular phone 1200 includes, in addition to a plurality of operation buttons 1202, an earpiece 1204, a mouthpiece 1206, and the above-described electro-optical device 100.

Figure 7:
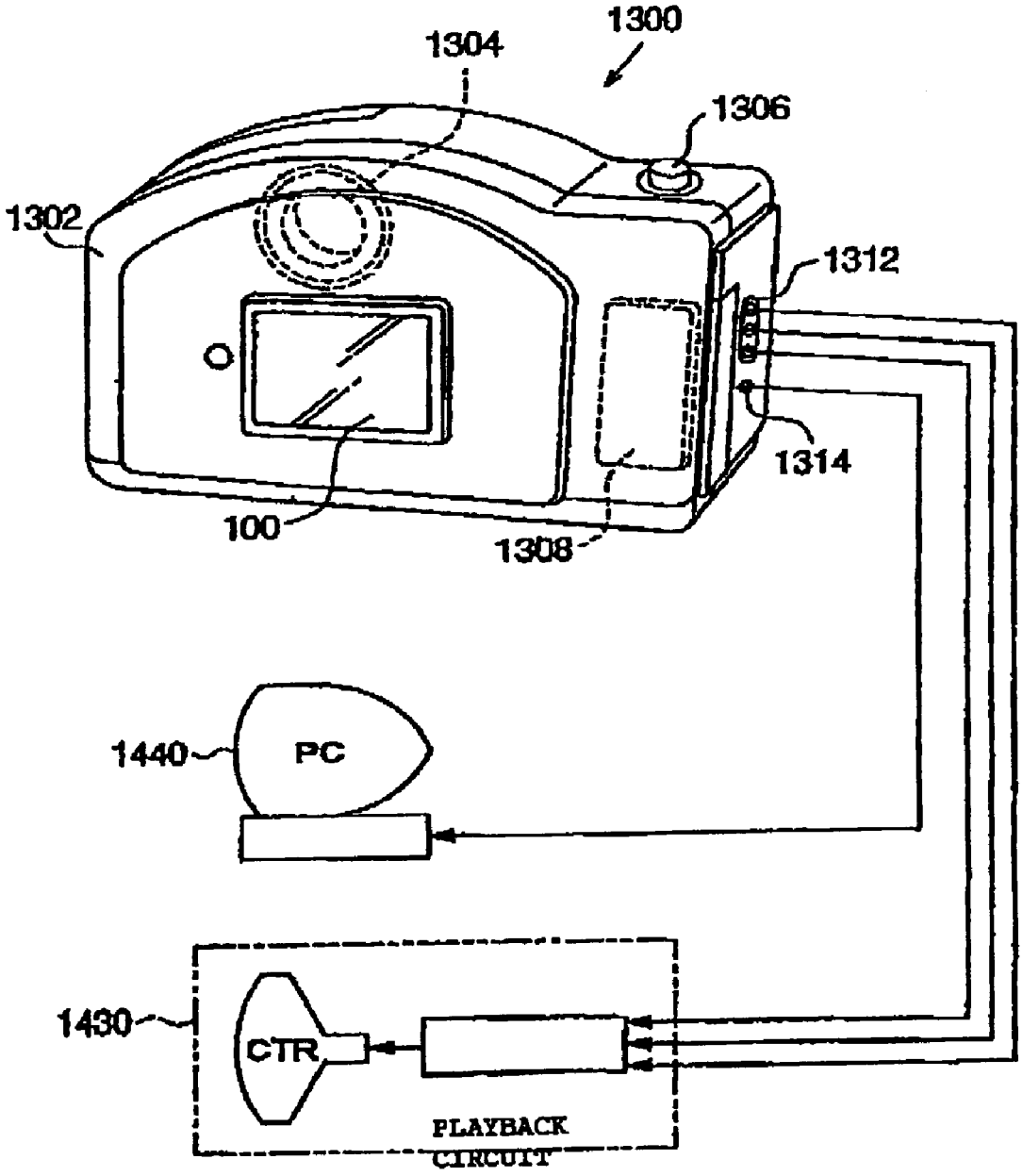
FIG. 7 is a schematic perspective view of a digital still camera in which the electronic device according to the first exemplary embodiment of the present invention is applied to the finder of the camera.

In addition, FIG. 7 is a perspective view of a digital still camera in which the above-described organic EL display device 100 is applied to its finder. FIG. 7 also shows interfacing with external units in a simplified form. Here, an ordinary camera 1300 generates an image-capturing signal by using image-capturing devices such as CCDs (Charge Coupled Devices) to perform photoelectrical conversion on an optical image of a subject. On the back of a housing 1302 for the digital still camera, the organic EL display device is provided, and displaying is performed based on the image-capturing signal by the CCDs. The organic EL display device functions as a finder to display the subject. On the observing side (the back side in the figure) of the housing 1302, a photo-receiving unit 1304 including an optical lens and CCDs is provided.

When a person who takes a picture presses a shutter button 1306 after confirming the image of the subject which is displayed on the organic EL display device, the image-capturing signal by the CCDs at the time is transferred and stored in a memory on a circuit substrate 1308. In the digital still camera 1300, on a side of the housing 1302, video-signal output terminals 1312 and a data-communicating input/output terminal 1314 are provided. As shown in FIG. 7, a television monitor 1430 is connected to the former video-signal output terminals 1312, and a personal computer 1440 is connected to the latter data-communicating input/output terminal 1314, as required. Predetermined operations output, to the television monitor 1430 or the personal computer 1440, the image-capturing signal which is stored in the memory on the circuit substrate 1308.

Electronic apparatuses to which the organic EL display device of the present invention can be applied include, in addition to the personal computer in FIG. 5, the cellular phone in FIG. 6, and the digital still camera in FIG. 7, televisions, video tape recorders of a view-finder type and a monitor-direct-view type, car navigation apparatuses, pagers, electronic pocketbooks, electronic calculators, word processors, workstations, video phones, POS terminals, devices with touch panels, smart robots, light-control illuminating devices, electronic books, electric spectacular devices, and electronic printing and copying apparatuses, for example. The above-described organic EL display device and driving method can be applied as display units for various other electronic apparatuses and electro-optical converters.

Second and third exemplary embodiments, which are next described, show specific examples in which screen brightness is time-controlled in an example in the first exemplary embodiment. In the exemplary embodiments, off-control of a driving current in the current-driven element is not performed by allocating display-off codes, but display-off control for a pixel circuit in at least one sub-period is performed, and the driving current is turned off in a simplified form.

Second Exemplary Embodiment

Next, the second exemplary embodiment of the present invention is described with reference to the drawings. In this exemplary embodiment, for an electronic device and its driving method according to the present invention, an organic EL display device, and for a driving method therefor, an organic EL display device and a method of controlling the effective screen lightness (brightness) are described as examples.

Figure 8:
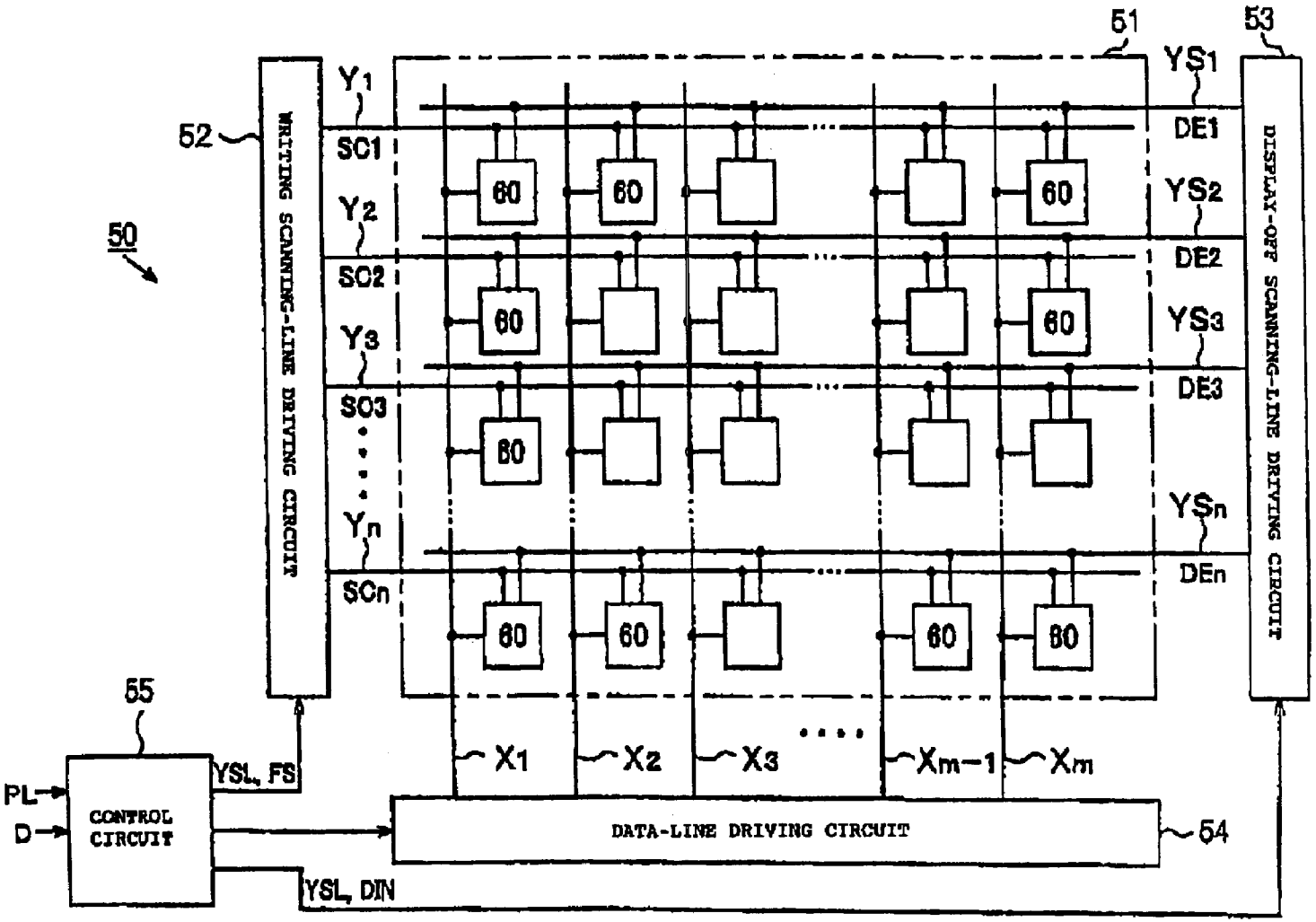
FIG. 8 is a schematic of a circuit of an organic EL display device according to a second exemplary embodiment of the present invention.

In FIG. 8, an organic EL display device 50 includes a display panel unit 51, a writing-scanning-line driving circuit 52, a display-off scanning-line driving circuit 53, a data-line driving circuit 54, and a control circuit 55.

In the organic EL display device 50, the display panel unit 51, the writing-scanning-line driving circuit 52, the display-off scanning-line driving circuit 53, the data-line driving circuit 54, and the control circuit 55 may be formed by separate electronic components, respectively. For example, the writing-scanning-line driving circuit 52, the display-off scanning-line driving circuit 53, the data-line driving circuit 54, and the control circuit 55 may be formed by a single-chip semiconductor integrated circuit. By using an integrated circuit in this manner, high precision, size reduction, and an increase in assembly efficiency can be achieved. Also, all or part of the display panel unit 51, the writing-scanning-line driving circuit 52, the display-off scanning-line driving circuit 53, the data-line driving circuit 54, and the control circuit 55 may be integrated as an electronic component. For example, in the display panel 51, the writing-scanning-line driving circuit 52, the display-off scanning-line driving circuit 53, and the data-line driving circuit 54 may be formed in an integrated form. Also, all or part of the writing-scanning-line driving circuit 52, the display-off scanning-line driving circuit 53, the data-line driving circuit 54 and the control circuit 55 may be formed as a programmable IC chip, and its functions may be implemented in the form of software by a program written into the IC chip.

The display panel unit 51 has a plurality of pixel circuits 60 arranged in a matrix, as shown in FIG. 8. Specifically, the pixel circuits 60 are provided corresponding to portions where a plurality of (m) data lines X1 to Xm (m is a natural number) extending in the column direction and a plurality of (n) writing scanning lines (n is a natural number) extending in the row direction cross one another. Each pixel circuit 60 is connected between each of the data lines X1 to Xm and each of the corresponding writing scanning lines Y1 to Yn, whereby the pixel circuits 60 are arranged in a matrix.

In addition, the pixel circuits 60 are connected to a plurality of (identical to the number of writing scanning lines Y1 to Yn) display-off scanning lines YS1 to YSn (n is a natural number) extending in the row direction, respectively.

Each pixel circuit 60 includes an organic EL display device 61 as a current-driven element or driven element whose light-emitting layer is made of organic material. A transistor formed in the pixel circuit 60, which is described below, is normally a thin film transistor (TFT).

Figure 9:
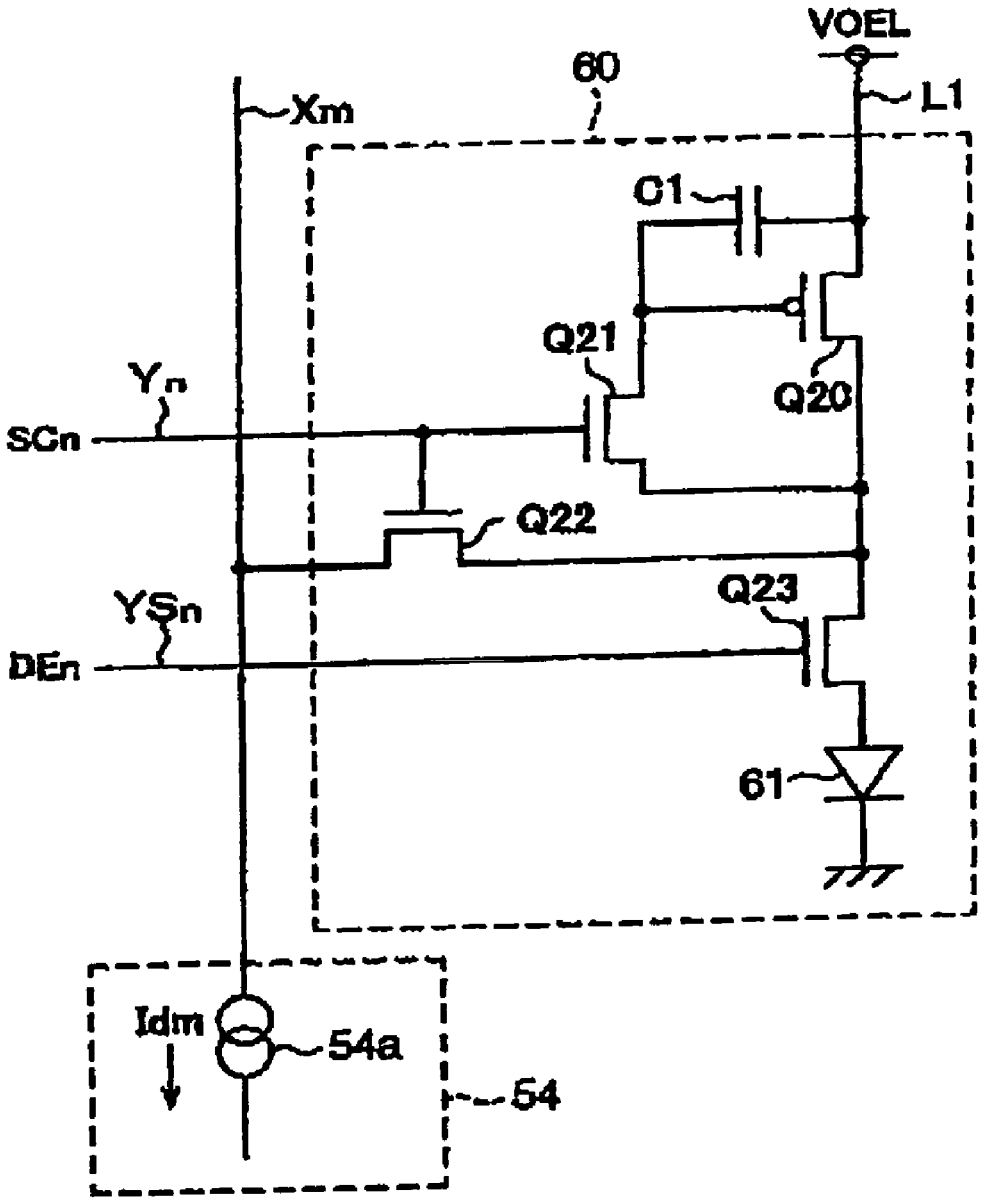
FIG. 9 is a schematic of a circuit of a pixel circuit according to the second exemplary embodiment of the present invention.
Figure 10:
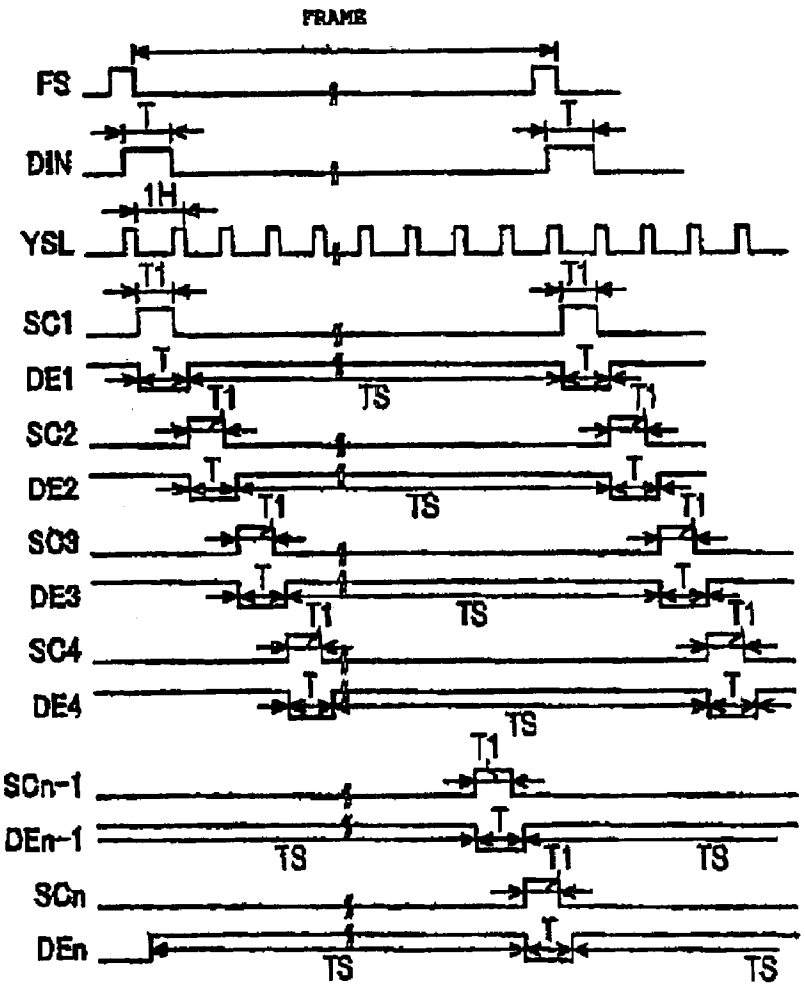
FIG. 10 is a time chart illustrating the operation of the organic EL display device according to the second exemplary embodiment of the present invention.
Figure 11:
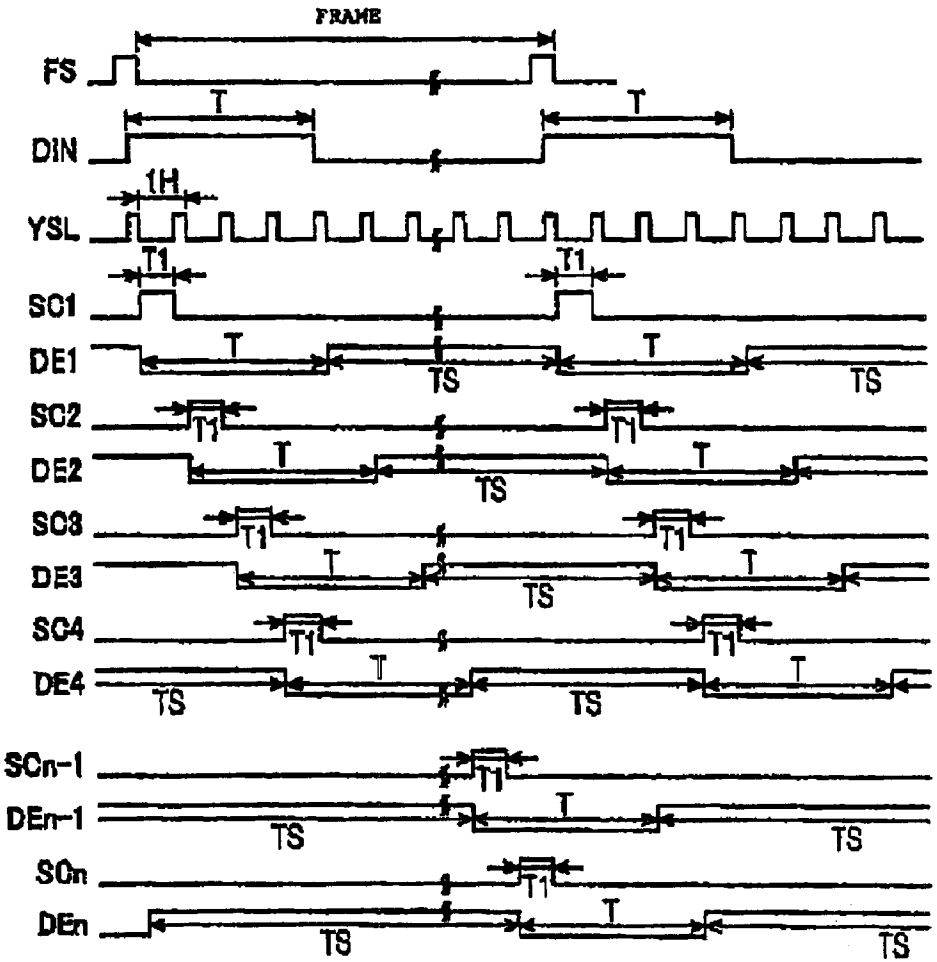
FIG. 11 is a time chart illustrating the operation of the organic EL display device according to the second exemplary embodiment of the present invention.

FIG. 9 is a schematic of an electric circuit as an example illustrating the internal circuit structure of the pixel circuit 60. For brevity of description, one pixel circuit 60 is described which is disposed in a point corresponding to the m-th data line Xm, the n-th writing scanning line Yn, and a display-off scanning line YSn, and which is connected to both data lines Xm, and the scanning lines Yn and YSn. Corresponding control time charts are shown in FIG. 10 and FIG. 11. FIG. 10 shows a case in which the organic EL display device 61 is turned off only during a period (one horizontal period) in which a standard display-data current Idm is programmed. FIG. 11 is a chart showing a specific example of a case in which time-control of the present invention is consecutively applied to the case in FIG. 10.

The pixel circuit 60 includes a driving transistor Q20, first and second switching transistors Q21 and Q22, a starting transistor Q23, and a holding capacitor C1 as a capacitive element. The driving transistor Q20 is formed by a P-channel FET. The first and second switching transistors Q21 and Q22, and the starting transistor Q23 are formed by N-channel FETs.

The driving transistor Q20 has a drain connected to the positive electrode of the organic EL display device 61 by the starting transistor Q23, and a source connected to a power-supply line L1. The power-supply line L1 is supplied with a driving voltage $V_{OEL}$ for driving the organic EL display device 61. The holding capacitor C1 is connected to the gate of the driving transistor Q1 and the power-supply line L1.

In addition, the first switching transistor Q21 is connected across the gate and drain of the driving transistor Q20. The gate of the first switching transistor Q21, and the gate of the second switching transistor Q22, are connected to the writing scanning line Yn, and from the writing scanning line Yn, each writing scanning signal SCn is input.

The drain of the switching transistor Q22 is connected to the drain of the driving transistor Q20. The source of the second switching transistor Q22 is connected to the data line Xm. The gate of the starting transistor Q23 is connected to the display-off scanning line YSn, from the display-off scanning line YSn, a display-off scanning signal DEn is input. The starting transistor Q23 that is connected in series to the driving transistor Q20 is used as an off-control transistor.

Now, the first and second switching transistors are in off-states. From the states, only during a predetermined time T1 (see FIG. 10 and FIG. 11), a writing scanning signal SCn in H-level and the display-off scanning signal DEn in L-level are output to the gates of the first and second switching transistors Q21 and Q22 through the scanning line Yn while synchronizing with a scanning clock signal YSL. When the first and second switching transistors Q21 and Q22 are turned on in response to the writing scanning signal SCn, the driving transistor Q20 sets, in the holding capacitor C1, the gate voltage required to cause a data current Idm from the data line Xm.

The value of the data current Idm is determined based on gray scale data by a data driving circuit 54. As a result, the voltage applied to the gate of the driving transistor Q20 drops to a voltage based on the data current Idm so that a characteristic change of the transistor Q20 can be compensated in self-matching form.

When the writing scanning signal SCn is in L-level in synchronization with a rise of the scanning clock signal YSL, the first and second switching transistors Q21 and Q22 are turned off and the supply of the current to the holding capacitor C1 is cut off. At this time, turning off of both transistors Q21 and Q22 causes the capacitor C1 to maintain a voltage corresponding to the data current Idm.

Subsequently, when the display-off scanning signal DEn in H-level is output from the display-off scanning line YSn while being synchronized with a drop of the scanning clock signal YSL, the starting transistor Q23 is turned on. It is assumed that the driving-off data signal DIN is input to the display-off scanning-line driving circuit behind the rise of the scanning clock signal YSL. Turning on of the starting transistor Q23 causes the driving transistor Q20 to be in a conduction state in accordance with the value of the data current Idm held in the holding capacitor C1, and a driving current according to the data current Idm is supplied to the organic EL element 61. The organic EL element 61 emits light at a brightness in accordance with the data current Idm until the writing scanning line Yn is next selected.

At this time, by controlling timing with which the starting transistor Q23 is turned on, and the display-off scanning signal DEn output from the display-off scanning line YSn, brightness is controlled. In other words, in each pixel circuit 60, by controlling the timing with which the starting transistor Q23 is turned on while using the data current Idm to represent intermediate tones, the lightness of the screen (the entire dot matrix) is adjusted. Specifically, in each pixel circuit 60, by delaying the timing with which the starting transistor Q23 is turned on, the period of light emission is shortened. Thus, the lightness (brightness) of the entire screen can be darkened. Conversely, for each pixel circuit 60, by accelerating the timing with which the starting transistor Q23 is turned on, the period of light emission is lengthened. Thus, the lightness (brightness) of the entire screen can be lightened.

The writing scanning-line driving circuit 52 is a circuit which selects one of the writing scanning lines Y1 to Yn, that is, outputs writing scanning signals SCI to SCn and driving pixel circuits 60 connected to the selected writing scanning line. Based on the scanning clock signal YSL and a frame-start signal FS from the control circuit 55, the scanning-line driving circuit 52 outputs the writing scanning signals SCI to SCn to the scanning lines Y1 to Yn with predetermined timing as shown FIG. 10.

The display-off scanning-line driving circuit 53 is a circuit which simultaneously selects one of the display-off scanning lines YS1 to YSn, that is, outputs the optical disk scanning signals DE1 to DEn and sequentially drives pixel circuits 60 connected to the selected writing scanning line. Based on the scanning clock signal YSL and the driving-off data signal DIN from the control circuit 55, the display-off scanning-line driving circuit 53 outputs the display-off scanning lines DE1 to DEn in synchronization with the writing scanning-line driving circuit 52. In other words, in the order of selecting the writing scanning lines by the writing scanning-line driving circuit 52, the display-off scanning-line driving circuit 63 sequentially selects the pixel circuits 60 on the selected, connected scanning lines, and outputs the display-off scanning signal. Specifically, as shown in FIG. 10, when the writing scanning signals SCI to SCn are sequentially output, the display-off scanning-line driving circuit 63 sequentially outputs the display-off scanning signals DE1 to DEn in L-level in response to the writing scanning signals SCI to SCn, and a time that is determined by the pulse width T of the driving-off data signal DIN elapses, the display-off scanning signals DE1 to DEn sequentially rise from L-level to H-level.

The data-line driving circuit 54 includes data-current output circuits 54*a* (see FIG. 9) for each of the data lines X1 to Xm. The gray scale data from the control circuit 55 is input to each data-current output circuit 54*a*, and it outputs, based on the gray scale data, generates and outputs data currents Id1 to Idm to the corresponding data lines X1 to Xm while being synchronized with the writing scanning signal.

In order that the organic EL display device 50 represents display data D for one frame, the control circuit 55 generates, based on the display data D for one frame, gray scale data to generate the data currents Id1 to Idm for the writing scanning lines Y1 to Yn, which are sequentially selected, to the pixel circuits 60 connected to the scanning lines Y1 to Yn. The control circuit 55 outputs the generated gray scale data to the data-current output circuits 54*a* of the data-line driving circuit 54 with predetermined timing. The circuit in FIG. 1 is included in the control circuit 55.

The control circuit 55 outputs, to the writing scanning-line driving circuit 52, a scanning clock signal YSL, and a frame-start signal FS representing start timing for one frame. The writing scanning-line driving circuit 52 sequentially selects, based on the scanning clock signal YSL and the frame-start signal FS, the scanning lines, and generates writing scanning signals SCI to SCn to control the pixel circuits 60 on the selected scanning line.

The control circuit 55 generates a scanning clock signal YSL and a driving-off data signal DIN for the driving-off scanning-line driving circuit 53. The driving-off data signal DIN is a signal that determines a time T after the display-off scanning signals DE1 to DEn are lowered from the H-level to the L-level until they are raised from the L-level to the H-level. In other words, a time in which the starting transistor Q23 is set to be in the off-state is determined. The driving-off data signal DIN is a signal in which the pulse width T is controlled by a screen-brightness control signal PL which is input from an external unit to the control circuit 55 and which represents the lightness (brightness) of the entire screen. The types of this screen-brightness control signal PL may include a signal output by a manual operation, a signal calculated based on external light by the external unit, and a control signal related to moving picture displaying, for example.

By way of example, when a screen-brightness control signal PL to increase the lightness (brightness) of the entire screen of the organic EL display device 50 is output from an external unit in response to a manual operation or dark external light, the control circuit 55 outputs a driving-off data signal DIN including a short pulse width T (corresponding to one horizontal scanning period (1H)), as shown in FIG. 10. Conversely, when a screen-brightness control signal PL to slightly lower the lightness (brightness) of the entire screen of the organic EL display device 50 is output from the external unit in response to a manual operation or relatively bright external light, the control circuit 55 outputs a driving-off data signal DIN including a long pulse width T (corresponding to four times one horizontal scanning period (1H)), as shown in FIG. 11.

Therefore, when the control circuit 55 outputs the driving-off data signal DIN including a short pulse width T (corresponding to one horizontal scanning period (1H)), as shown in FIG. 10, light emission in accordance with data currents in the organic EL elements 61 of the pixel circuits 60 on the selected writing scanning line is initiated when the next writing scanning line is selected.

Also, when the control circuit 55 outputs the driving-off data signal DIN including a long pulse width T (corresponding to four times one horizontal scanning period (1H)), as shown in FIG. 11, light emission in accordance with data currents in the organic EL elements 61 of the pixel circuits 60 on the selected writing scanning line is initiated when a writing scanning line is selected after the off-state continues in the off-period of the pulse width T of the driving-off data signal DIN.

Accordingly, a light-emitting period TS based on the driving-off data signal DIN shown in FIG. 10, is longer than a light-emitting period TS based on the driving-off data signal DIN shown in FIG. 11, so that the lightness (brightness) of the entire screen is increased. In other words, the data currents can represent gray scales and the driving-off data signal DIN can adjust the lightness (brightness) of the entire screen. In the case of controlling the lightness (brightness) of the entire screen by controlling the light-emitting period, it is preferable in preventing color blurring that at least off-periods be set for the R (red), G (green), and B (blue) of one pixel. However, in accordance with the electro-optical characteristics, color balance, etc., of R (red), G (green), and B (blue), the on-period length may be set, as required.

Electronic apparatuses to which the organic EL display device 50 according to this exemplary embodiment is applied include, in addition to the personal computer in FIG. 5, the cellular phone in FIG. 6, and the digital still camera in FIG. 7, televisions, video tape recorders of a view-finder type and a monitor-direct-view type, car navigation apparatuses, pagers, electronic pocketbooks, electronic calculators, word processors, workstations, video phones, POS terminals, devices with touch panels, smart robots, light-control illuminating devices, electronic books, electric spectacular devices, and electronic printing and copying apparatuses, for example. The above-described organic EL display device and driving method can be applied as display units and electro-optical converters for various other electronic apparatuses.

Third Exemplary Embodiment

Next, a third exemplary embodiment of the present invention is described with reference to the drawings. In this exemplary embodiment, for an electronic device and its driving method according to the present invention, an organic EL display device, and for a driving method therefor, an organic EL display device and a method of controlling the effective screen lightness (brightness) are described as examples. This exemplary embodiment differs from the second exemplary embodiment in the circuit arrangement of the pixel circuits and in timing of the light-emitting period TS. Accordingly, for convenience of description, characteristic portions are fully described.

Figure 12:
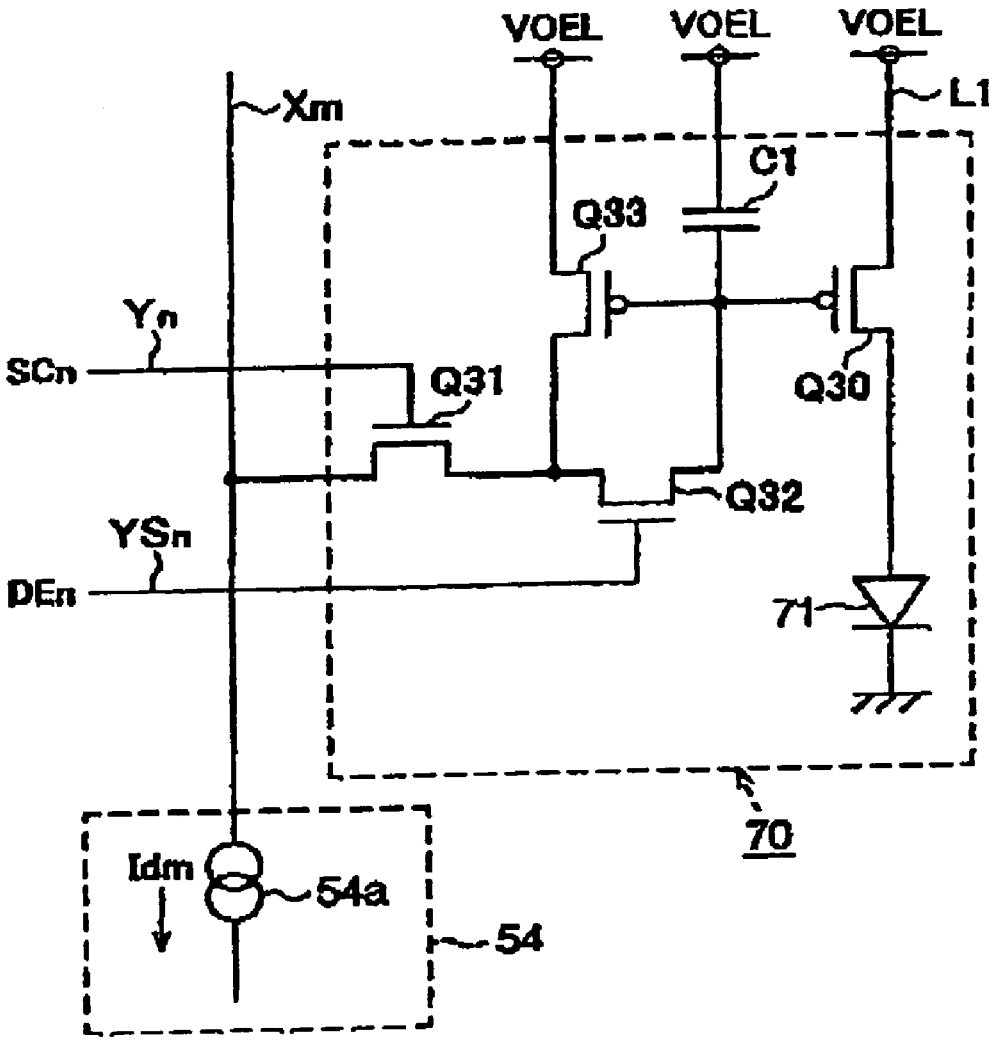
FIG. 12 is a schematic of a circuit of a pixel circuit according to a third exemplary embodiment of the present invention.

The pixel circuit 70 shown in FIG. 12 is disposed in a point corresponding to the m-th data line Xm, the n-th writing scanning line Yn, and the display-off scanning line YSn, similarly to the foregoing embodiment, and shows another example of a pixel circuit connected to both data lines Xm and the scanning lines Yn and YSn.

The pixel circuit 70 includes a driving transistor Q30, a first switching transistor Q31, a second switching transistor Q32, a converting transistor Q33, and a holding capacitor C1 as a capacitive element. The driving transistor Q30 and the converting transistor Q33 are formed by P-channel FETs. The first and second switching transistors Q21 and Q22 are formed by N-channel FETs.

The driving transistor Q30 has a drain connected to the positive electrode of an organic EL element 71, and a source connected to a power-supply line L1. The power-supply line L1 is supplied with a driving voltage $V_{OEL}$ to drive the organic EL element 71. One end of the holding capacitor C1 is connected to the gate of the driving transistor Q30, and the driving voltage $V_{OEL}$ is applied to the other end of the holding capacitor C1. The gate of the driving transistor Q30 is connected to the gate of the converting transistor Q33, and the driving voltage $V_{OEL}$ is applied to the source of the converting transistor Q33.

The transistors Q32, Q33, and Q30 constitute a current-mirror circuit, and ideally, the current flowing in the transistor 33 in the size ratio between the transistor Q33 and the transistor Q30 proportionally decreases and flows into the transistor Q30.

The drain of the converting transistor Q33 is connected to the data line Xm by the first switching transistor Q31. The gate of the first switching transistor Q21 is connected to the writing scanning line Yn, and from the writing scanning line Yn, a writing scanning signal SCn is input.

The second switching transistor Q32 as an off-control transistor is connected across the gate and drain of the converting transistor Q33. The gate of the second switching transistor Q32 is connected to the display-off scanning line YSn, and from the display-off scanning line YSn, a display-off scanning signal DEn is input.

Next, the operation of the pixel circuit 70 having the above structure is described.

Now, the writing scanning signal SCn is in L-level, and the display-off scanning signal DEn is in H-level. At this time, the first switching transistor Q31 is in an off-state, and the second switching transistor Q32 is in an on-state. From this condition, the writing scanning signal SCn, which is in H-level, is output to the gate of each first switching transistor Q31 through the scanning line Yn only during a predetermined time T1 (see FIG. 13). When the first switching transistor Q31 is turned on in response to the writing scanning signal SCn, a data current Idm is supplied from the data line Xm through the first switching transistor Q31. At this time, the gate voltage of the converting transistor Q33 has a voltage level which is relative to the data current Idm, and the voltage level is held in the holding capacitor C1.

As a result, the voltage applied to the gate of the driving transistor Q30 has a voltage level based on the data current Idm, and the driving transistor Q30 supplies the organic EL element 71 with the amount of a current which is relative to the data current Idm. In other words, a driving current which is proportional to the data current Idm is supplied to the organic EL element 71, and the organic EL element 71 initiates light emission with gray scale according to the data current Idm.

Subsequently, after the time T1 elapses, when the writing scanning signal SCn, which is in H-level, drops from the H-level to the L-level, the first switching transistor Q31 is in an off-state. Simultaneously therewith, the display-off scanning signal DEn drops from the H-level to the L-level, the second switching transistor Q32 is also turned off. This causes the holding capacitor C1 to maintain the voltage level according to the data current Idm. As a result, the driving transistor Q30 continues to supply the organic EL element 71 with the amount of a current in proportion to the data current Idm, so that the organic EL element 71 emits light with gray scale according to the data current Idm.

After that, when the display-off scanning signal DEn rises from the L-level to the H-level, the second switching transistor Q32 is turned on, and electric charges stored in the capacitor C1 discharge through the converting transistor Q33 are discharged, so that the gate voltages of the converting transistor Q33 and the driving transistor Q30 are raised to almost turn off the transistor Q33 and the transistor 30. As a result, light emission of the organic EL element 71 stops and is on standby until the writing scanning line Yn is next selected.

Figure 13:
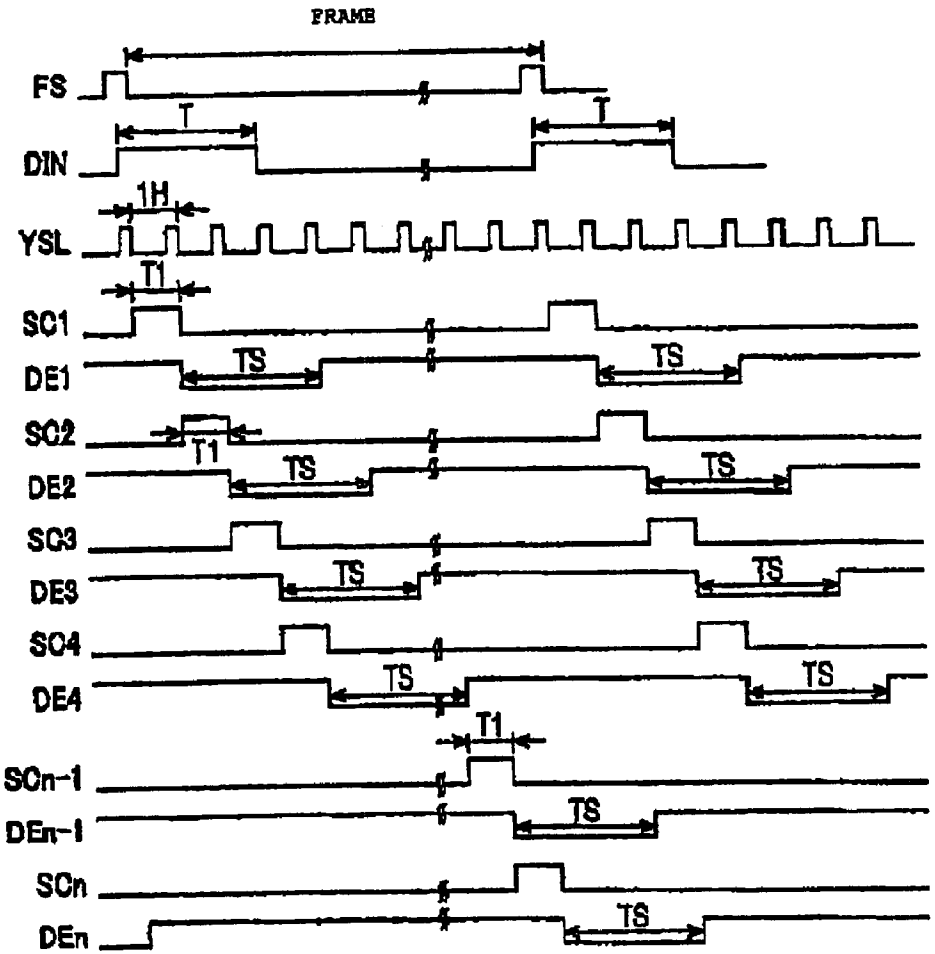
FIG. 13 is a time chart illustrating the operation of the organic EL display device according to the third exemplary embodiment of the present invention.

Specifically, the pixel circuit 70 in this embodiment differs from the pixel circuit 60 in that, conversely to the above-described exemplary embodiment, as shown in FIG. 13, the light-emitting period TS starts simultaneously with the writing of the data current Idm since the pixel circuit 70 emits light until the display-off scanning signal DEn rises from the L-level to the H-level. Accordingly, also, in the case of using the screen-brightness control signal PL to set the pulse width T of the driving-off data signal DIN, changing is required in accordance therewith.

By controlling timing with which the second switching transistor Q32 is turned on, that is, the display-off scanning signal DEn output from the display-off scanning line YSn, the lightness (brightness) of the entire screen is controlled. In other words, also, in each pixel circuit 70, by controlling timing with which the second switching transistor Q32 is turned on while using the data current Idm to represent intermediate tones, the lightness (brightness) of the screen (the entire dot matrix) is adjusted. In other words, the second switching transistor Q32 controls the light-emitting period TS and shares a portion of a circuit to set the data current Idm. Specifically, by accelerating the timing with which the second switching transistor Q32 is in the on-state in the pixel circuit 70, the lightness (brightness) of the entire screen can be reduced since the light-emitting period TS shortens. Conversely, by delaying the timing with which the second switching transistor Q32 is in the on-state in the pixel circuit 70, the lightness (brightness) of the entire screen can be increased since the light-emitting period TS lengthens. In the case of controlling the lightness (brightness) of the entire screen by controlling the light-emitting period, it is preferable in preventing color blurring that at least off-periods be set for the R (red), G (green), and B (blue) of one pixel. However, in accordance with the electro-optical characteristics, the desired color balance, etc., of R (red), G (green), and B (blue), the on-period length may be set, as required.

Electronic apparatuses to which the organic EL display device according to this exemplary embodiment is applied include, in addition to the personal computer in FIG. 5, the cellular phone in FIG. 6, and the digital still camera in FIG. 7, televisions, video tape recorders of a view-finder type and a monitor-direct-view type, car navigation apparatuses, pagers, electronic pocketbooks, electronic calculators, word processors, workstations, video phones, POS terminals, devices with touch panels, smart robots, light-control illuminating devices, electronic books, electric spectacular devices, and electronic printing and copying apparatuses, for example. The above-described organic EL display device and driving method can be applied as display units and electro-optical converters for various other electronic apparatuses.

In addition, as the third exemplary embodiment shows, in the pixel circuit 60 described in the second exemplary embodiment, the light-emitting period TS may be set to start simultaneously with writing of the data current Idm.

Moreover, in the second and third exemplary embodiments, the display device as an electronic device is a color display device, and when a current value corresponding to low gray scale is set corresponding to light-emitting elements as current-driven elements or driven elements for different colors, such as R (red), G (green), and B (blue) in the screen, or a light-emitting period is set corresponding to the lightness (brightness) of the entire screen, and the electric characteristics differ, the exemplary embodiments may be implemented by changing a current value for a light-emitting element of each color, or a light-emitting period so as to match the characteristics.

Although the second and third exemplary embodiments use sequential scanning when performing scanning by the scanning lines, leaped scanning may be implemented.

In each of the foregoing exemplary embodiments, a display device is embodied which includes organic electroluminescence elements (organic EL elements) as current-driven optical elements. However, the present invention may be applied to display apparatuses, and print and electronic copying apparatuses which include vacuum fluorescent display devices (hereinafter referred to as VFDs), inorganic electroluminescence elements, laser devices such as light-emitting-diode (LED-device) surface-emitting lasers (VCSELs), or voltage-controlled thin-film emitting devices such as field emission devices (FEDs), for example.

Moreover, although, in each of the foregoing exemplary embodiments, the present invention is embodied in the form of an electro-optical device as an electronic device using electro-optical elements, it may be applied to electronic devices such as memory device using a magnetic RAM as, for example, a driven element.

The invention claimed is:

1. A method of driving an electronic device that includes a scanning line, a signal line, a current-driven element and a first transistor that includes a first gate, the method comprising:

supplying a first data current that sets a gate voltage of the first gate to a first voltage level, the first data current being supplied through the signal line;

supplying a first driving current whose level corresponds to the first voltage level to the current-driven element during a first period;

supplying a second data current whose current level is different from a current level of the first data current and that sets the gate voltage to a second voltage level, the second data current being supplied through the signal line; and supplying a second driving current whose level corresponds to the second voltage level to the current-driven element during a second period, a first length of the first period being different from a second length of the second period.

2. The method according to claim 1, a second transistor that controls an electrical connection between the first transistor and the current-driven element being in an on-state during the first period and the second period.

3. The method according to claim 1, a third transistor that controls an electrical connection between the first gate and a first drain of the first transistor being in an off-state during the first period and the second period.

4. The method according to claim 1, the first data current and the second data current being generated by a data-line driving circuit that generates a plurality of data currents whose current levels are different from each other and that includes the first data current and the second data current.

5. A method of driving an electronic device that includes a scanning line, a signal line, a current-driven element and a first transistor having a first gate, the method comprising:

supplying a first data current that sets a gate voltage of the first gate to a first voltage level;

supplying a first driving current whose level corresponds to the first voltage level to the current-driven element during a first period;

supplying a second data current whose current level is different from a current level of the first data current and that sets the gate voltage to a second voltage level;

supplying a second driving current whose level corresponds to the second voltage level to the current-driven element during a second period;

supplying a third data current that sets the gate voltage of the first gate to a third voltage level; and supplying a third driving current whose level corresponds to the third voltage level to the current-driven element during a third period, a first length of the first period being different from a second length of the second period, a third length of the third period being equal to the first length, the first data current, the second data current and the third data current being generated by a data-line driving circuit that generates a plurality of groups of data currents, and the plurality of groups including a first group that includes the first data current and the third data current, and a second group that includes the second data current.

6. A method of driving an electronic device that includes a scanning line, a signal line, a current-driven element and a first transistor having a first gate, the method comprising:

supplying a first data current that sets a gate voltage of the first gate to a first voltage level;

supplying a first driving current whose level corresponds to the first voltage level to the current-driven element during a first period;

supplying a second data current whose current level is different from a current level of the first data current and that sets the gate voltage to a second voltage level;

supplying a second driving current whose level corresponds to the second voltage level to the current-driven element during a second period, the first data current and the second data current being generated by a data-line driving circuit that generates a plurality of groups of data currents, the first data current being included in one group of the plurality of the groups, and the second data current being included in another group of the plurality of groups.

7. A method of driving an electronic device that includes a scanning line, a signal line, a current-driven element and a first transistor having a first gate, the method comprising:

supplying a first data current that sets a gate voltage of the first gate to a first voltage level;

supplying a first driving current whose level corresponds to the first voltage level to the current-driven element during a first period;

supplying a second data current whose current level is different from a current level of the first data current and that sets the gate voltage to a second voltage level; and supplying a second driving current whose level corresponds to the second voltage level to the current-driven element during a second period, no current being supplied to the current-driven element during a fourth period that is before the first period or after the first period, and no current being supplied to the current-driven element during a fifth period that is before the second period or after the second period.

8. The method according to claim 7, a fourth length of the fourth period being different from a fifth length of the fifth period.

9. An electronic device, comprising:

a scanning line;

a signal line;

a first transistor that has a first gate, a first drain, and a first source; and a current-driven element, a gate voltage of the first gate being set to a first voltage level in a first period in which a first data current flowing through the signal line and in which the signal line is electrically connected to the first gate, the gate voltage of the first gate being set to a second voltage level in a second period in which a second data current flowing through the signal line and in which the signal line is electrically connected to the first gate, a first driving current whose current level corresponds to the first voltage level being supplied to the current-driven element during a third period, a second driving current whose current level corresponds to the second voltage level being supplied to the current-driven element during a fourth period, a length of the third period being different from the fourth period.

10. The electronic device according to claim 9, further comprising a second transistor that controls an electrical connection between the first transistor and the current-driven element and that is in an on-state during the third period and the fourth period.

11. The electronic device according to claim 9, further comprising a third transistor that controls an electrical connection between the first gate and the first drain and that is in an off-state during the third period and the fourth period.

12. The electronic device according to claim 9, further comprising a data-line driving circuit that generates a plurality of data currents whose current levels are different each other and that includes the first data current and the second data current.

13. The electronic device according to claim 9, further comprising a data-line driving circuit that generates a plurality of groups that includes a first group including the first data current and a second group including the second data current.

14. The electronic device according to claim 9, the gate voltage of the first gate being set to a third voltage level in a fifth period in which a third data current flowing through the signal line and in which the signal line is electrically connected to the first gate, the third data current being included in the first group, and a third driving current whose current level corresponds to the third voltage level being supplied to the current driven element during a sixth period whose length is equal to the length of the third period.

15. The electronic device according to claim 9, being supplied to the current-driven element during a seventh period that is before the third period or after the third period, and no current being supplied to the current-driven element during an eighth period before the fourth period or after the fourth period in which no current is supplied to the current driven element.

16. The electronic device according to claim 15, a length of the seventh period being different from a length of the eighth period.

17. The electronic device according to claim 9, the current-driven element being a current-driven optical element, the first data current corresponding to a first gray scale level of a plurality of gray scale levels of the optical element, and the second data current corresponding to a second gray scale level of the plurality of gray scale levels.

18. The electronic device according to claim 17, the first data current being included in a first group of a plurality of groups of data currents, the second data current being included in a second group of the plurality of groups, and each of the plurality of groups corresponding to a plurality of gray scale levels.

19. The electronic device according to claim 18, the gate voltage of the first gate being set to a third voltage level in a fifth period in which a third data current flowing through the signal line and in which the signal line is electrically connected to the first gate, the third data current being included in the first group, and a third driving current whose current level corresponds to the third voltage level being supplied to the current-driven element during a sixth period whose length is equal to the length of the third period.

20. An electronic apparatus comprising the electronic device according to claim 9.

* * * * *